US010197347B2

(12) United States Patent
Leitner-Wise et al.

(10) Patent No.: US 10,197,347 B2
(45) Date of Patent: Feb. 5, 2019

(54) BUFFER RETAINING PIN

(71) Applicants: Paul Leitner-Wise, Alexandria, VA (US); Christopher Donald Wood, Arlington, VA (US)

(72) Inventors: Paul Leitner-Wise, Alexandria, VA (US); Christopher Donald Wood, Arlington, VA (US)

( * ) Notice: Subject to any disclaimer, the term of this patent is extended or adjusted under 35 U.S.C. 154(b) by 0 days.

(21) Appl. No.: 15/694,352

(22) Filed: Sep. 1, 2017

(65) Prior Publication Data

US 2018/0274871 A1 Sep. 27, 2018

Related U.S. Application Data

(60) Provisional application No. 62/393,552, filed on Sep. 12, 2016.

(51) Int. Cl.
*F41A 3/84* (2006.01)

(52) U.S. Cl.
CPC ..... *F41A 3/84* (2013.01)

(58) Field of Classification Search
CPC ..... F41A 3/84
USPC ..... 89/198
See application file for complete search history.

(56) References Cited

U.S. PATENT DOCUMENTS

| | | | | |
|---|---|---|---|---|
| 1,359,609 | A * | 11/1920 | Lang | F41A 19/13 42/25 |
| 9,341,437 | B1 * | 5/2016 | Huang | F41A 3/84 |
| 2013/0269510 | A1 * | 10/2013 | Sullivan | F41A 5/28 89/193 |
| 2016/0209137 | A1 * | 7/2016 | DeSomma | F41A 3/82 |

OTHER PUBLICATIONS

"Paul Leitner-Wise design Gen 2 Heavy Duty Buffer Retainer", https://www.amazon.com/Paul-Leitner-Wise-design-Buffer-Retainer/dp/B07CX5SXSX (Year: 2018).*
"AR15 Heavy Duty Buffer Retainer", https://www.youtube.com/watch?v=PZUcZSYb8Xs (Year: 2016).*
"AR Platform Offset Buffer Retainer", http://commonbullets.com/wp/archives/1727 (Year: 2015).*

* cited by examiner

*Primary Examiner* — Samir Abdosh
(74) *Attorney, Agent, or Firm* — Christopher Wood

(57) ABSTRACT

In one aspect of the invention a buffer retaining pin is provided that comprises an elongate body. The elongate body comprises a cylindrical body portion. The elongate body has a longitudinal axis, a proximal end, and an opposite open distal end. The cylindrical body has an inner chamber in communication with the open distal end. A tooth is located at the proximal end of the elongate body. The tooth is integral with and extends from the cylindrical body such that the cylindrical body portion extends between the tooth and the open distal end. The tooth defines a top side, a left side, a right side, a front face, and a rear face. The front face of the tooth extends in a plane such that the plane of the front face intersects the longitudinal axis.

16 Claims, 8 Drawing Sheets

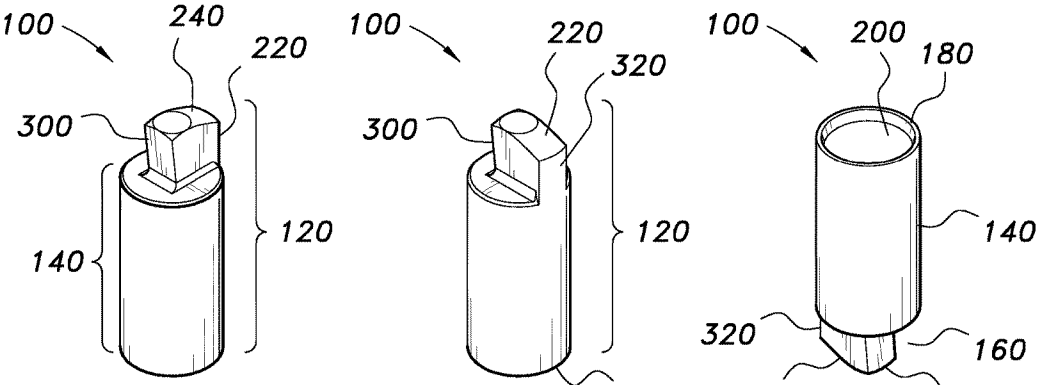
FIG. 1
FIG. 2
FIG. 3
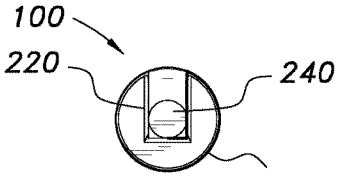
FIG. 4
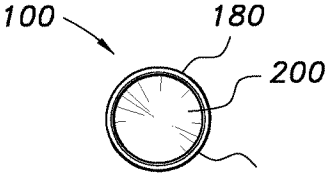
FIG. 5

| Table 1 | |
|---|---|
| *LA* | longitudinal axis *LA* |
| *FFP* | front face plane *FFP* of front face 300 of tooth 220 |
| *PA* | prior art |
| *Y* | angle *Y* |
| 100 | buffer retaining pin 100 |
| 120 | elongated body 120 |
| 140 | cylindrical body portion 140 |
| 160 | proximal end 160 |
| 180 | open distal end 180 |
| 200 | inner chamber 200 of cylindrical body portion 140 |
| 220 | tooth 220 |
| 240 | top side 240 of tooth 220 |
| 260 | left side 260 of tooth 220 |
| 280 | right side 280 of tooth 220 |
| 300 | front face 300 of tooth 220 |
| 320 | rear face 320 of tooth 220 |
| 340 | buffer 340 |
| 360 | spring 360 |
| 380 | blind hole 380 |

*FIG. 21*

BUFFER RETAINING PIN

CROSS REFERENCE TO RELATED APPLICATIONS

This application claims the benefit of U.S. Application No. 62/393,552, filed Sep. 12, 2016, the content of which is incorporated herein by reference in its entirety.

STATEMENT REGARDING FEDERALLY SPONSORED RESEARCH OR DEVELOPMENT

Not Applicable.

FIELD OF THE INVENTION

The present invention relates generally to retaining pins. More specifically, the invention is a buffer retaining pin having a front face that minimizes contact damage to a buffer upon contact between the buffer retaining pin and a buffer in weapons such as AR-15 rifles.

BACKGROUND OF THE INVENTION

A buffer is one of many pieces that helps a rifle to operate normally. When a bullet is fired the energy that it released pushes a bolt carrier backwards which then connects with the buffer which typically works with a buffer spring located in a buffer tube. At the point of contact, the buffer pushes the spring backwards. Depending on the weight of the buffer and the strength of the spring the buffer will reconnect with the bolt carrier pushing a new bullet forward into the chamber to be fired. Buffer retaining pins should prevent movement of the buffer beyond the buffer retaining pin (also known as "detents"). Buffer retaining pins of the prior art typically have a protrusion atop thereof of circular cross-section area. Such pins can fail in use thereby deleteriously affecting correct operation of the rifle.

More recently, a heavy duty buffer retaining pin invented by Paul Leitner-Wise has come onto the market. This buffer retaining pin (shown in FIGS. 16-17) offers greater reliability and resistance to mechanical stress than retaining pins having a circular cross-section. But for reasons described below even these improved buffer retaining pins create issues due to lack of effective contact surface area upon contact with a buffer. Therefore, there remains a need for a better buffer retaining pin.

SUMMARY OF THE INVENTION

In one aspect of the invention a buffer retaining pin is provided that comprises an elongate body. The elongate body comprises a cylindrical body portion. The elongate body has a longitudinal axis, a proximal end, and an opposite open distal end. The cylindrical body has an inner chamber in communication with the open distal end. A tooth is located at the proximal end of the elongate body. The tooth is integral with and extends from the cylindrical body such that the cylindrical body portion extends between the tooth and the open distal end. The tooth defines a top side, a left side, a right side, a front face, and a rear face. The front face of the tooth extends in a plane such that the plane of the front face intersects the longitudinal axis at a point between the proximal and distal ends, and more precisely between the tooth and the distal end; or the plane of the front face intersects the longitudinal axis at the distal end; or the plane of the front face intersects the longitudinal axis beyond the distal end.

BRIEF DESCRIPTION OF THE DRAWINGS

FIG. 1 is a front perspective view of a buffer retaining pin according to the present invention.

FIG. 2 is a rear perspective view of a buffer retaining pin according to the invention.

FIG. 3 is a bottom perspective view of a buffer retaining pin according to the invention.

FIG. 4 is a top plan view of a buffer retaining pin according to the invention.

FIG. 5 is a bottom plan view of a buffer retaining pin according to the invention.

FIG. 21 shows a list of part numbers.

Similar reference characters denote corresponding features consistently throughout the attached drawings.

DESCRIPTION OF THE PREFERRED EMBODIMENTS OF THE INVENTION

Figure 6:
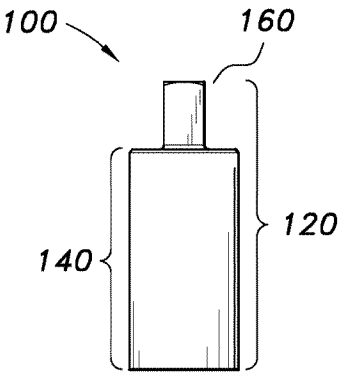
FIG. 6 is a front plan view of a buffer retaining pin according to the invention.
Figure 7:
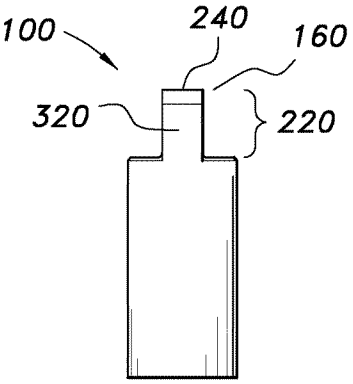
FIG. 7 is a rear plan view of a buffer retaining pin according to the invention.
Figure 8:
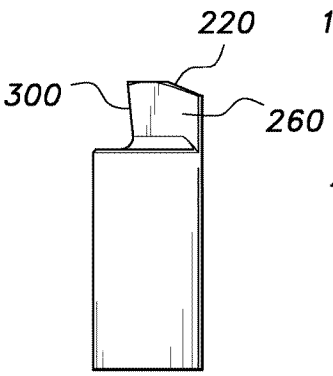
FIG. 8 is a left side view of a buffer retaining pin according to the invention.
Figure 9:
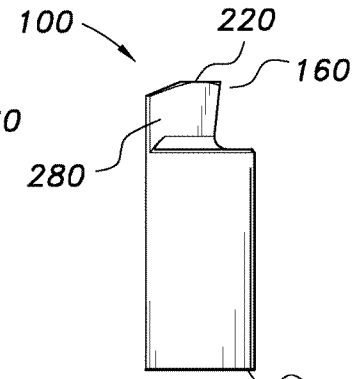
FIG. 9 is a right side view of a buffer retaining pin according to the invention.

Referring to the Figures in general, Table 1 (FIG. 21) is a useful point of reference.

The invention is directed to a buffer retaining pin 100 that comprises an elongate body 120. The elongate body 120 comprises a cylindrical body portion 140. The elongate body 120 has a longitudinal axis LA, a proximal end 160, and an opposite open distal end 180. The cylindrical body portion 140 has an inner chamber 200 in communication with the open distal end 180. A tooth 220 is located at the proximal end 160 of the buffer retaining pin 100. The tooth 220 is integral with and extends from the cylindrical body portion 140 such that the cylindrical body portion 140 extends between the open distal end 180 and the tooth 220. The tooth 220 defines a top side 240, a left side 260, a right side 280, a front face 300, and a rear face 320.

FIGS. 1 through 10 show various views of a buffer retaining pin 100 according to the invention.

Figure 10:
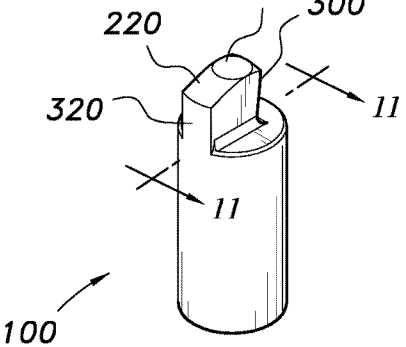
FIG. 10 is a rear perspective view of a buffer retaining pin according to the invention.
Figure 11:
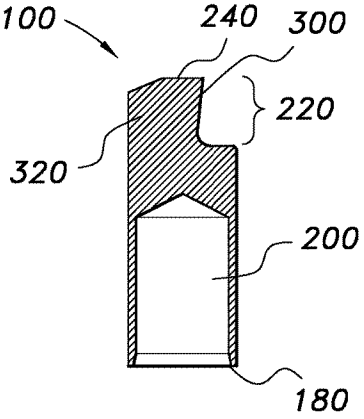
FIG. 11 is a section view taken along lines 11-11 of FIG. 10.

FIG. 11 is a section view taken along lines 11-11 in FIG. 10.

Figure 12:
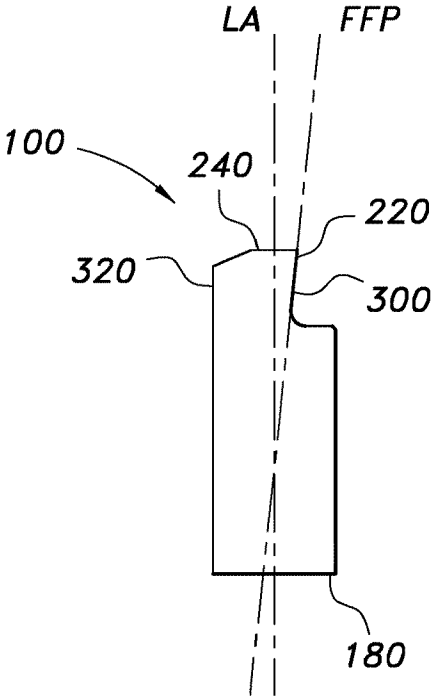
FIG. 12 shows one embodiment of the present invention.

Referring FIG. 12, the front face 300 of the tooth 220 extends in a plane FFP such that the plane FFP of the front face 300 intersects the longitudinal axis LA at a point between the proximal end 160 and the open distal end 180, and more precisely intersects the longitudinal axis LA between the tooth 220 and the distal end 180.

Figure 13A:
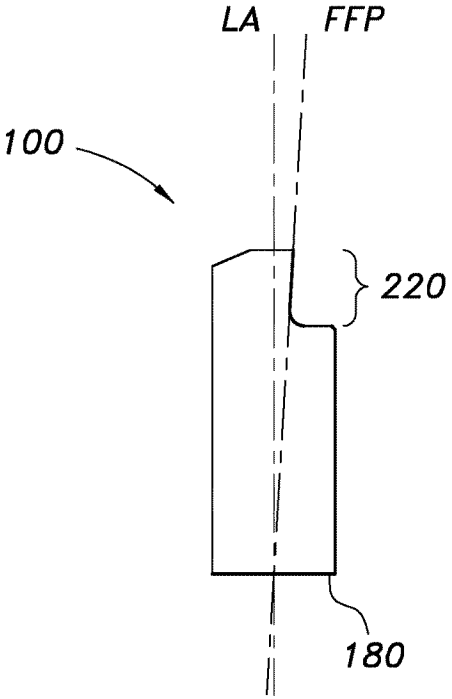
FIG. 13A shows a different embodiment of the present invention.
Figure 13:
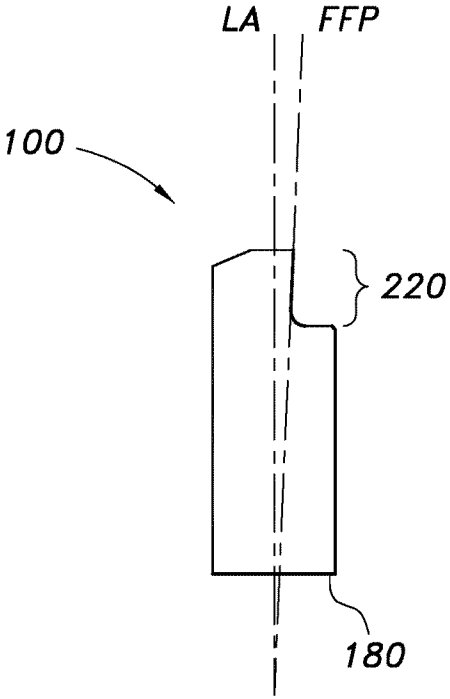
FIG. 13 shows a different embodiment of the present invention.

Referring to FIG. 13, the front face 300 of the tooth 220 extends in a plane FFP such that the plane FFP of the front face 300 intersects the longitudinal axis LA beyond the open distal end 180.

Referring to FIG. 13A, the front face 300 of the tooth 220 extends in a plane FFP such that the plane FFP of the front face 300 intersects the longitudinal axis LA at the distal end 180.

Figure 20:
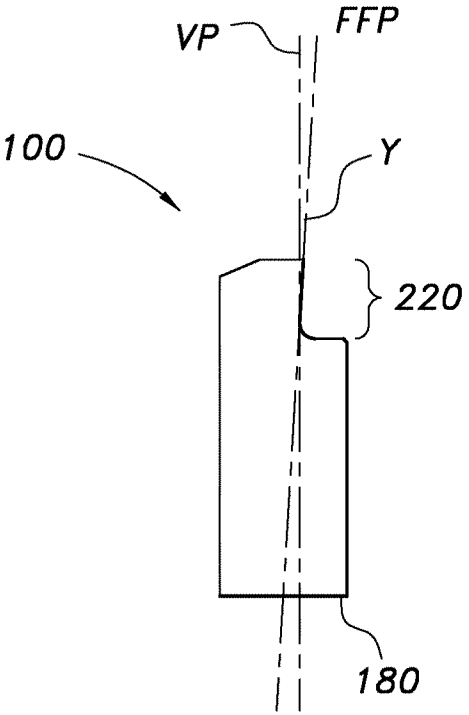
FIGS. 18-20 shows the buffer retaining pin according to the invention.
Figure 19:
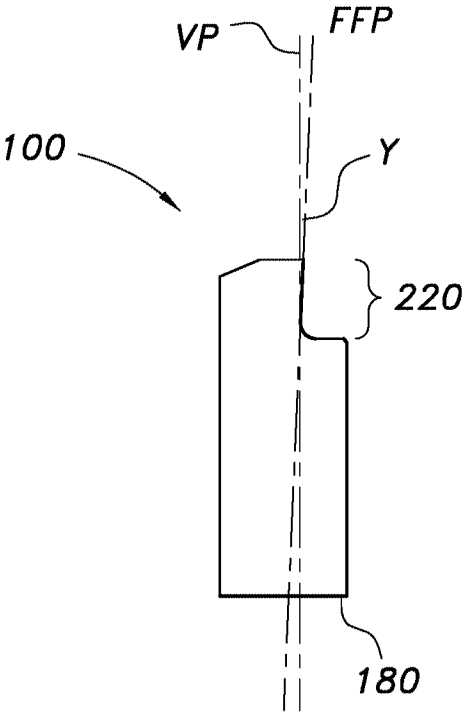
Figure 18:
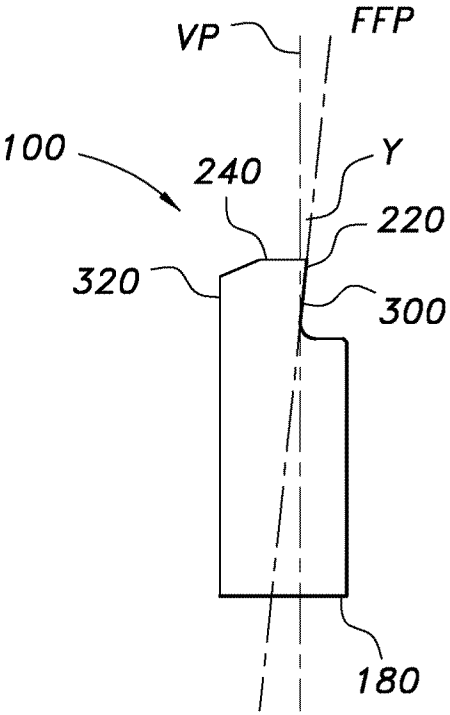

The optimum angle (represented by "Y" in FIGS. 18-20) between plane FFP and the vertical axis ("VP", i.e., when the buffer retaining pin 100 is placed in the vertical plane) to achieve flush contact between front face 300 and the buffer 340 is in the range from 4° to 8°, wherein the vertical plane VP is parallel to the longitudinal axis LA. An angle of 5° (plus/minus 1°) between plane FFP and vertical plane VP has been found to be suitable to achieve flush contact between front face 300 and the buffer 40.

Figure 14:
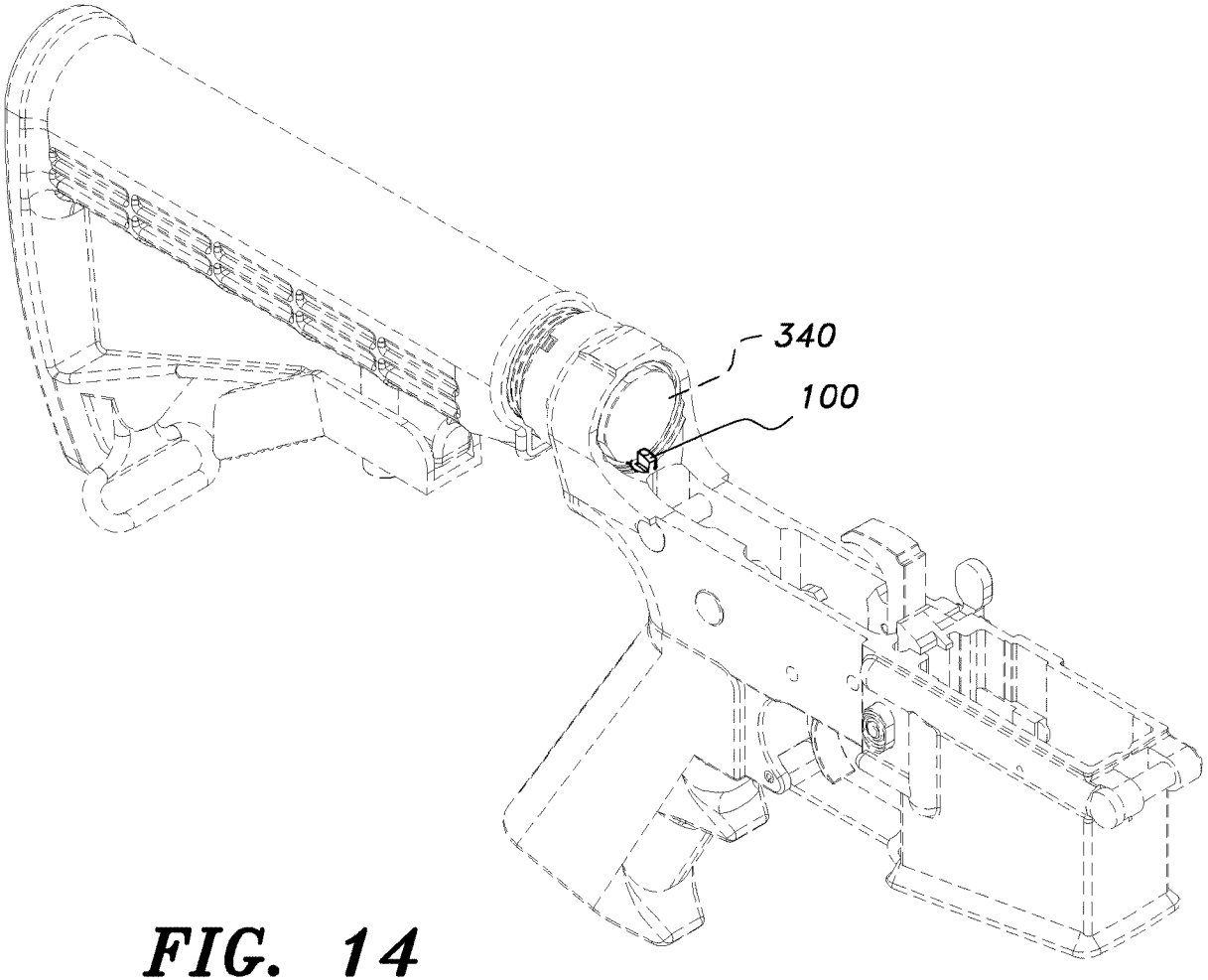
FIG. 14 shows an environmental view with respect to a buffer retaining pin according to the invention.

FIG. 14 shows an environmental view with respect to the buffer retaining pin 100 according to the invention.

Figure 15:
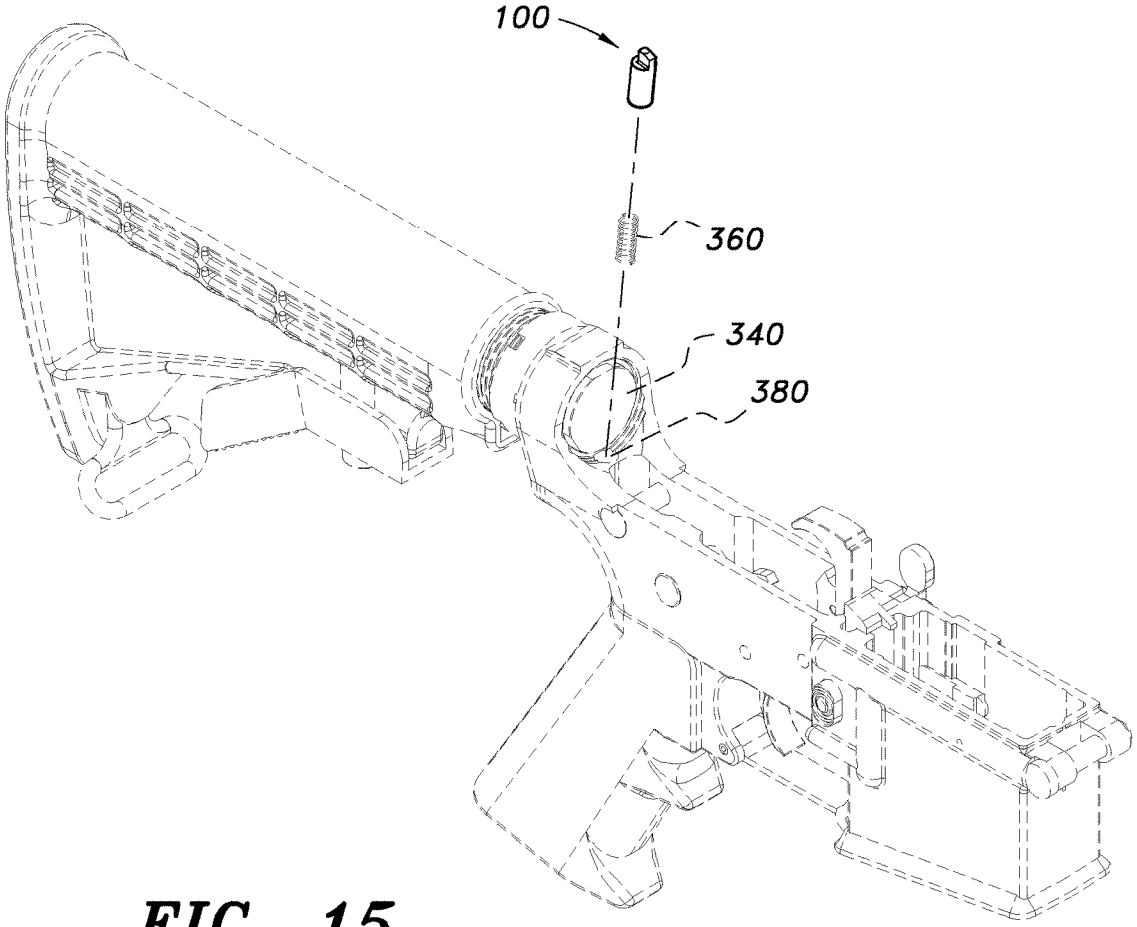
FIG. 15 shows a partial exploded view of FIG. 14.

FIG. 15 shows a partial exploded view of FIG. 14.

Figure 16:
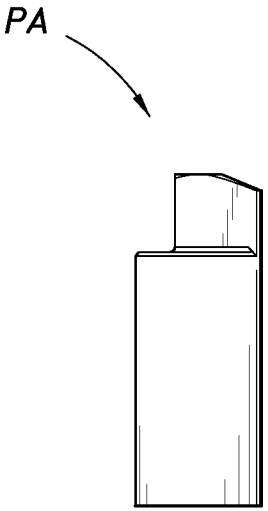
(PRIOR ART) FIG. 16
FIGS. 16 and 17 show opposite side views of a prior art buffer retaining pin.
Figure 17:
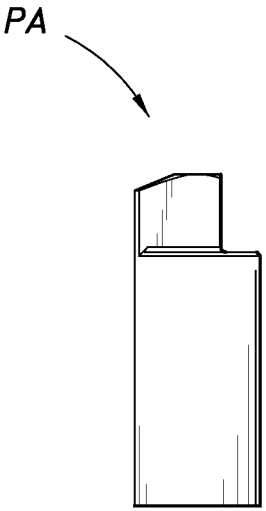
(PRIOR ART) FIG. 17

FIGS. 16-17 show side views of a prior art buffer retaining pin. As can be seen in FIGS. 16 and 17, it is self-evident that the front face of the prior art buffer retaining pin (shown but not labeled) does not extend in a plane that intersects the longitudinal axis of the prior art buffer retaining pin. More specifically, the plane of the front face of the prior art buffer retaining pin is parallel to the longitudinal axis of the prior art buffer retaining pin. Therefore, the front face of the prior art buffer retaining pin does not make a flush contact with the buffer. That is, the contact between the prior art buffer retaining pin is not flush with the exterior surface of the buffer.

In direct contrast, the buffer retaining pin of the present invention makes a flush contact with the buffer which results in less wear on the buffer and the buffer retaining pin of the present invention.

During normal use the buffer retaining pin is located in a blind hole 380 which itself is set an acute angle relative to the vertical plane when the rifle is held in the horizontal plane. This arrangement is required to allow the buffer retaining pin to be installed in the blind hole 380. The prior art buffer retaining pins fail to compensate for this acute angle. However, the buffer retaining pin 100 of the present invention compensates for this by having a front face 300 of tooth 220 having a plane FFP that intersects the longitudinal axis LA at a point between the proximal and distal ends 160 and 180 (and more precisely the plane FFP intersects the longitudinal axis LA between the tooth 220 and the distal end 180), or the plane FFP intersects the longitudinal axis LA beyond the distal end 180 of the buffer retaining pin 100 according to the present invention.

During normal use of the buffer retaining pin 100, a bolt carrier (not shown) slides over the tooth 220. More specifically, when a bolt carrier slides over the tooth 220, a groove (not shown) in the underside of the bolt carrier fits over the tooth 220 thereby allowing a bolt carrier to slide over the tooth 220.

The buffer retaining pin 100 can be made out of any suitable material such as steel alloy. Also, because the buffer 340 rests flush against the tooth 220 instead of, for example, at an acute angle, less stress is imposed on the tooth 220. This allows the buffer retaining pin 100 to be made of material other than steel alloy such as, but not limited to, aluminum or aluminum alloy without affecting performance and reliability of the buffer retaining pin 100 of the invention.

Moreover, making the buffer retaining tube 100 of a material based on aluminum provides a further distinct advantage over steel buffer retaining pins of the prior art in that the buffer retaining pin 100 of the invention can be made out of exactly the same material as the buffer 340, which is often made of aluminum or aluminum alloy; this is very important because steel is and aluminum or aluminum alloy are dissimilar metals having different electrode potentials and which upon contact in the presence of an electrolyte can undergo galvanic corrosion. Water, in particular water containing ions found in natural environments such as rivers and lakes, can act as an electrolyte leading to galvanic corrosion between an aluminum buffer 340 and steel buffer retaining pins of the prior art. Since the front face 300 of tooth 220 fits flush with the aluminum buffer 340 it is particularly advantageous that the buffer retaining pin 100 can be made of aluminum or aluminum alloy of the same or similar electrode potential as the buffer 40.

The flush nature of contact that occurs between the front face 300 of the tooth 220 of the present invention and buffer 340 in AR-15 rifles allows the buffer retaining pin 100 to be made out of non-metallic materials such as, but not limited to, ceramics. This is particularly useful because ceramic materials are typically hard materials. Also, when the buffer retaining pin 100 of the present invention is made of ceramic non-metal material his avoids galvanic corrosion issues even in the presence of electrolyte loaded water such as sea water.

It is to be understood that the present invention is not limited to the embodiments described above, but encompasses any and all embodiments within the scope of the following claims.

What is claimed:

1. A buffer retaining pin, comprising:

an elongate body having a longitudinal axis, said elongated body having:

a proximal end, an opposite open distal end, a tooth is located at the proximal end, the tooth defines a top side, a left side, a right side, a front face, and a rear face, the front face extends in a plane such that the plane intersects the longitudinal axis at a point between the tooth and distal end, and a cylindrical body portion, wherein the tooth is integral with and extends from the cylindrical body such that the cylindrical body portion extends between the distal end and the tooth, the cylindrical body comprises an inner chamber in communication with the open distal end.

2. The buffer retaining pin of claim 1, wherein the buffer retaining pin is made of aluminum.

3. The buffer retaining pin of claim 1, wherein the buffer retaining pin is made of aluminum alloy.

4. The buffer retaining pin of claim 1, wherein the buffer retaining pin is made of ceramic.

5. A buffer retaining pin, comprising:

an elongate body having a longitudinal axis, said elongated body having:

a proximal end, an opposite open distal end, a tooth is located at the proximal end, the tooth defines a top side, a left side, a right side, a front face, and a rear face, the front face extends in a plane such that the plane intersects the longitudinal axis at a point beyond the distal end, and a cylindrical body portion, wherein the tooth is integral with and extends from the cylindrical body such that the cylindrical body portion extends between the distal end and the tooth, the cylindrical body comprises an inner chamber in communication with the open distal end.

6. The buffer retaining pin of claim 5, wherein the buffer retaining pin comprises of aluminum.

7. The buffer retaining pin of claim 5, wherein the buffer retaining pin is made of aluminum alloy.

8. The buffer retaining pin of claim 5, wherein the buffer retaining pin is made of ceramic.

9. A buffer retaining pin, comprising:

an elongate body having a longitudinal axis, said elongated body having:

a proximal end, an opposite open distal end, a tooth located at the proximal end, the tooth defines a top side, a left side, a right side, a front face, and a rear face, the front face extends in a plane such that the plane intersects the longitudinal axis at the distal end of the elongated body, and a cylindrical body portion, wherein the tooth is integral with and extends from the cylindrical body such that the cylindrical body portion extends between the distal end and the tooth, the cylindrical body comprises an inner chamber in communication with the open distal end.

10. The buffer retaining pin of claim 9, wherein the buffer retaining pin comprises of aluminum.

11. The buffer retaining pin of claim 9, wherein the buffer retaining pin is made of aluminum alloy.

12. The buffer retaining pin of claim 9, wherein the buffer retaining pin is made of ceramic.

13. The buffer retaining pin of claim 9, wherein the plane intersects the longitudinal axis at the distal end of the elongated body.

14. The buffer retaining pin of claim 9, wherein the plane intersects the longitudinal axis at an angle in the range from 4° to 8°.

15. The buffer retaining pin of claim 9, wherein the plane intersects the longitudinal axis at an angle in the range from 4° to 6°.

16. The buffer retaining pin of claim 9, wherein the plane intersects the longitudinal axis at an angle of 5°.

* * * * *